US005872582A

United States Patent [19]

Pan

[11] Patent Number: 5,872,582

[45] Date of Patent: Feb. 16, 1999

[54] MICROFLUID VALVE FOR MODULATING FLUID FLOW WITHIN AN INK-JET PRINTER

[75] Inventor: Alfred I-Tsung Pan, Sunnyvale, Calif.

[73] Assignee: Hewlett-Packard Company, Palo Alto, Calif.

[21] Appl. No.: 675,366

[22] Filed: Jul. 2, 1996

[51] Int. Cl.[6] ..... B41J 2/05

[52] U.S. Cl. ..... 347/65; 347/15; 347/67; 347/84

[58] Field of Search ..... 347/94, 15, 65, 347/84, 85, 67

[56] References Cited

U.S. PATENT DOCUMENTS

| | | | |
|---|---|---|---|
| 3,087,438 | 4/1963 | Ciesielski | 417/207 |
| 4,487,662 | 12/1984 | Fischbeck | 204/15 |
| 4,494,128 | 1/1985 | Vaught | 347/15 X |
| 4,496,960 | 1/1985 | Fischbeck | 347/94 X |
| 4,514,742 | 4/1985 | Suga | 347/94 X |
| 4,723,129 | 2/1988 | Endo | 347/56 |
| 5,129,794 | 7/1992 | Beatty | 417/413 |
| 5,291,226 | 3/1994 | Schantz et al. | 347/47 X |
| 5,305,015 | 4/1994 | Schantz et al. | 347/47 |
| 5,305,018 | 4/1994 | Schantz et al. | 347/47 X |
| 5,371,529 | 12/1994 | Eguchi | 347/68 X |
| 5,408,738 | 4/1995 | Schantz et al. | 29/611 |
| 5,442,384 | 8/1995 | Schantz et al. | 347/20 |
| 5,457,485 | 10/1995 | Moriyama et al. | 347/92 |

FOREIGN PATENT DOCUMENTS

| | | | |
|---|---|---|---|
| 309146A2 | 9/1988 | European Pat. Off. | B41J 3/04 |
| 436047A1 | 1/1990 | European Pat. Off. | B41J 2/055 |
| 655337A2 | 11/1994 | European Pat. Off. | B41J 2/205 |
| 62-214962 | 9/1987 | Japan | B41J 3/04 |
| 63-028654 | 2/1988 | Japan | B41J 3/04 |
| 2254044 | 9/1992 | United Kingdom | B32B 3/24 |
| 2136597 | 9/1994 | United Kingdom | F15C 1/00 |

*Primary Examiner*—Joseph Hartary

[57] ABSTRACT

A valve device is incorporated within a printhead of an ink-jet pen for regulation of ink flow and pressure within the printhead. The valve device includes a valve member comprising a resiliently deformable flap positioned in an ink channel, adjacent a firing chamber. The flap is deflectable into and out of a position to regulate ink flow and pressure both to and from the ink firing chambers.

7 Claims, 4 Drawing Sheets

MICROFLUID VALVE FOR MODULATING FLUID FLOW WITHIN AN INK-JET PRINTER

FIELD OF THE INVENTION

The present invention relates to a device for controlling fluid flow and pressure within an ink-jet printhead.

BACKGROUND

An ink-jet printer includes a pen in which small droplets of ink are formed and ejected toward a printing medium. The pen is mounted to a reciprocating carriage in the printer. Such pens include printheads with orifice plates having very small nozzles through which ink droplets are ejected. Adjacent to the nozzles are ink chambers where ink is stored prior to ejection. Ink is delivered to the ink chambers through ink channels that are in fluid communication with an ink supply. The ink supply may be, for example, contained in a reservoir section of the pen or supplied to the pen from a remote site.

Ejection of an ink droplet through a nozzle may be accomplished by quickly heating a volume of ink within the adjacent ink chamber. The thermal process causes ink within the chamber to superheat and form a vapor bubble. Formation of a thermal ink-jet vapor bubble is known as "nucleation." The rapid expansion of ink vapor forces a drop of ink through the orifice. This process is called "firing." Ink in the chamber may be heated, for example, with a resistor that is responsive to a control signal. The resistor is aligned adjacent the nozzle.

Ink-jet printheads typically rely on capillary forces to draw ink through the ink channels to the ink chambers. As used herein, the term "back pressure" means a partial vacuum within the printhead. Back pressure is considered in the positive sense, so that an increase in back pressure represents an increase in the partial vacuum. The capillary forces overcome a slightly positive back pressure created by a regulator. Once ink is ejected from the chamber, the chamber is refilled by the capillary force, readying the system for firing another droplet.

As ink rushes in to refill an empty chamber, the inertia of the moving ink causes some of the ink to bulge out of the orifice. Because ink within the pen is generally kept at a slightly positive back pressure, the bulging portion of the ink immediately recoils back into the ink chamber. This reciprocating motion diminishes over a few cycles and eventually stops or damps out.

If a droplet is fired when the ink is bulging out the orifice, the ejected droplet will be dumbbell shaped and slow moving. Conversely, if the ink is ejected when ink is recoiling from the nozzle, the ejected droplet will be spear shaped and move undesirably fast. Between these two extremes, as the ink motion damps out in the chamber, well-formed drops are produced for optimum print quality.

Print speed (that is, the rate at which droplets are ejected) must be sufficiently slow to allow the ink motion within the chamber to damp out between droplet firing. The time period required for the ink motion to damp sufficiently may be referred to as the damping interval.

To lessen the print speed reduction attributable to the damping interval, ink chamber geometry has been manipulated. The chambers are constricted in a way that reduces the ink chamber refill speed in an effort to rapidly damp the bulging, refilling ink. Generally, chamber length and area are constructed to lessen the reciprocating motion of chamber refill ink (hence, lessen the damping interval). However, printheads have been unable to eliminate the damping interval. Thus, print speed must accommodate the damping interval, or print and image quality suffer.

Ink-jet printheads are also susceptible to ink "blowback" during droplet ejection. Blowback results when some ink in the chamber is forced back into the adjacent part of the channel upon firing. Blowback occurs because the chamber is in constant fluid communication with the channel, hence, upon firing, a large portion of ink within the chamber is not ejected from the printhead, but rather is blown back into the channel.

Blowback wastes some energy that is for ejection of droplets from the chamber ("turn on energy" or TOE) because only a portion of the entire volume of ink in the chamber is actually ejected. Thus, reducing blowback reduces TOE to increase the thermal efficiency of an ink-jet pen. Moreover, higher TOE results in excessive printhead heating. Excessive printhead heating generates bubbles from air dissolved in the ink, causing prenucleation of the ink vapor bubble. Air bubbles and prenucleation result in poor print quality.

SUMMARY OF THE INVENTION

The present invention provides a system for controlling fluid flow and fluid pressure within an ink-jet printhead. In a preferred embodiment of the present invention, fluid flow and pressure within the printhead is controlled by a passive valve device affixed to or integral with a printhead of an ink-jet pen.

In accordance with a preferred embodiment of the present invention the valve device includes at least one minute, passive valve member. The valve member comprises a resiliently deformable flap positioned in the ink channel adjacent to a firing chamber. The flap is deflectable into and out of a position to regulate ink flow and pressure both to and from the ink firing chambers.

The valve member is deformable into a position that substantially isolates the ink chamber from the channel during firing of an ink droplet. Such isolation of the ink chamber reduces ink blowback. During ejection, ink in the chamber is blocked by the deformed valve member and cannot blowback into the ink channel, but must exit through the nozzle. Reducing ink blowback furthers regulation of fluid pressure within the pen and reduces TOE.

Moreover, with a valve member deformed in such a manner, the ink chamber is isolated immediately after the ink chamber is refilled thereby reducing the ink damping interval. That is, with an isolated ink chamber, the distance bulging ink may recoil back from the nozzle is limited, reducing the reciprocating motion of ink.

The present invention may be micromachined, providing low cost, wafer-based batch processing and repeatability.

DESCRIPTION OF PREFERRED EMBODIMENTS

Figure 1:
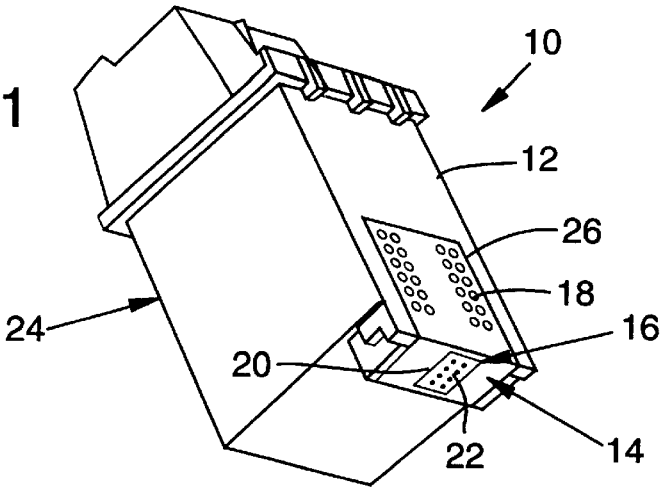
Fig. 1 is perspective view of an ink-jet printer pen that includes a preferred embodiment of the printhead valve device.

Referring to FIG. 1, the valve device of the present invention is incorporated within an ink-jet printer pen 10. The pen includes a pen body 12 defining a reservoir 24. The reservoir 24 is configured to hold a quantity of ink. A printhead 20 is fit into the bottom 14 of the pen body 12 and controlled for ejecting ink droplets from the reservoir 24. The printhead 20 defines a set of nozzles 22 for expelling ink, in a controlled pattern, during printing. Each nozzle 22 is in fluid communication with a firing chamber defined in the base of printhead 20.

Figure 2:
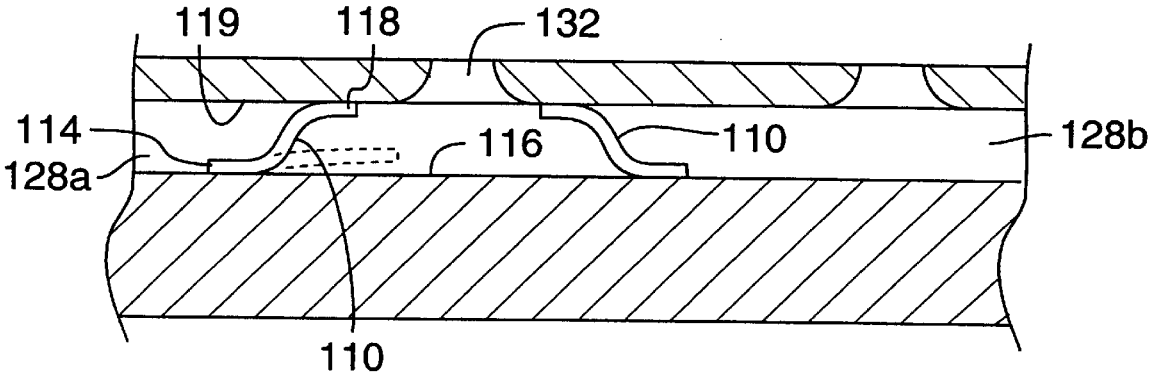
FIG. 2 stan enlarged cross-sectional partial view of a preferred embodiment of the device of the present invention.

A supply conduit (not shown) conducts ink from the reservoir 24 (FIG. 1) to ink channels 128*a* and 128*b*, defined by the printhead (FIG. 2). The ink channels are configured so that ink moving therethrough is in fluid communication with each firing chamber 132 (FIG. 2).

Each firing chamber 132 has associated with it a thin-film resistor. The resistors are selectively driven (heated) by current applied by an external microprocessor and associated drivers. Conductive drive lines to each resistor are carried upon a circuit 26 mounted to the exterior of the pen body 12 (FIG. 1). Circuit contact pads 18 (shown enlarged for illustration) at the ends of the resistor drive lines engage similar pads carried on a matching circuit attached to the carriage (not shown).

Valve member 110 is affixed within printhead 20 of ink-jet pen 10 (FIGS. 1 and 2). More particularly, valve member 110 is connected to or integral with the printhead ink channels 128*a* and 128*b*. The valve member is located between an ink supply and the firing chambers 132.

The ink channels 128*a* and 128*b* define an upstream and downstream ink flow path, respectively, relative to the valve device. The ink channels comprise a continuous pathway for ink flowing from an ink supply to the firing chamber. More particularly, an ink supply within the pen reservoir 24, or at a site remote of the pen 10, is in fluid communication with ink channel 128*a*.

In a preferred embodiment of the present invention, valve member 110 is constructed of a resiliently deformable material that is movable into an open or a closed position within the ink channel, as described below.

Valve member 110 is connected at one, fixed end 114, to lower surface 116 of channel 128*b*. Free end 118 of valve member 110 is movable in a direction toward lower surface 116 of channel 128*b* or toward the opposing, upper surface 119 of the channel. When the valve member 110 is in a deformed position, free end 118 is in contact with upper surface 119 and the valve member is in a closed position (depicted by solid lines in FIG. 2). When the valve member is in a closed position, ink flow from ink channel 128*b* to firing chamber 132 is substantially reduced. When valve member 110 is in a non-deformed or relaxed position, free end 118 is moved in a direction toward lower surface 116 to an open position (depicted by dashed lines in FIG. 2). When valve 110 is in an open position ink may flow through ink channel 128*b* to firing chamber 132.

When fluid ink pressure within ink channel 128*b*, between firing chamber 132 and valve member 110 increases above a preselected level, the fluid pressure forces valve member 110 to the closed position. That is, free end 118 of the valve member is deflected to contact upper surface 119 thereby significantly reducing ink flow to the firing chamber 132 (FIG. 2).

When fluid pressure within the ink channel, between firing chamber 132 and valve member 110, decreases below a preselected level, valve member 110 returns to the open position. Thus, free end 118 of valve member 110 resiles in a direction toward lower surface 116 thereby allowing ink to flow from the ink supply to the firing chambers 132. It is notable that valve member 110 may be fabricated such that the valve member is normally in a closed position and is deformable to an open position.

Preferably, two valve members 110 are positioned on either side of and adjacent to an ink firing chamber 132. Two valve members 110 positioned on opposing sides of firing chamber 132 isolate the firing chamber from ink channel 128*b* when the valve members 110 are deflected to a closed position. It is contemplated, however, that a single valve member could be used in designs where the chamber has a single connection with an ink channel.

Figure 4A:
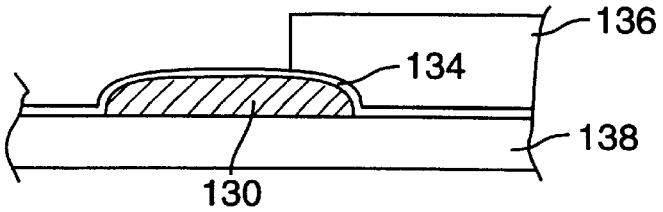
FIGS. 4*a*–4*c* depict the sequence of steps for fabricating the embodiment of the present invent illustrated in FIG. 2.

Isolating the ink firing chamber during the firing process reduces ink blowback upon firing of the resistor, thereby further regulating fluid flow and pressure within the printhead. Preferably, each firing chamber 132 has associated with it at least one valve member 110. Valve member 110 may be fabricated utilizing conventional thin-film layering techniques (illustrated in FIGS. 4*a*–4*c*). Fabrication starting material may comprise a plated metallic substrate or a polymer substrate 138 (FIG. 4*a*). Suitable plated metallic substrates preferably comprise nickel, while suitable polymer substrates preferably comprise polyimide.

Figure 4B:
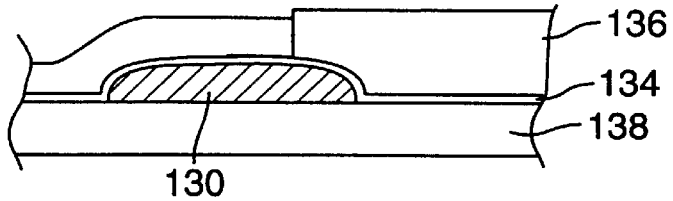
Figure 4C:
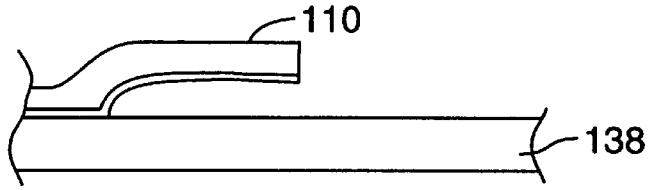

A relatively thick sacrificial photoresist layer 130 is patterned on substrate 138 preferably at about 20 m in thickness 25 m in width (as measured perpendicular to the cross-section of valve member 110 depicted in FIG. 4*c*) and 40 m in length (FIG. 4*a*). Dimensions of sacrificial layer 130 are dictated by the desired valve member 110 dimensions. Sacrificial layer 130 is later removed to allow valve member 110 to move free of the substrate 138. The exposed surface of the substrate becomes the lower surface 116 of ink channel 128*b* (FIG. 2).

A thin conductor layer 134 is applied uniformly over substrate 138 and sacrificial layer 130 (FIG. 4*a*). A preferred conductor layer 134 comprises titanium and gold, deposited by conventional sputtering techniques or chromium and copper also deposited by sputtering. The titanium (or chromium) functions as an adherent, while the gold (or copper) functions as the current carrier during the plating process. Layer 134 is preferably about 1000 in thickness.

A second sacrificial photoresist layer 136 is applied on conductor layer 134 and patterned to define the length, width and height of valve member 110 (FIG. 4*b*). Valve member 110, preferably comprising nickel, is then plated to cover the exposed portions of conductor layer 134. Following deposition of valve member 110, photoresist layer 136 and exposed portion of layer 134 are removed (FIG. 4*c*). Photoresist layer 130 is then removed and valve member 110 is then free to move at one end.

The ink channel may also be fabricated simultaneously with valve member 110 or separately on an ink channel mating surface.

Figure 8:
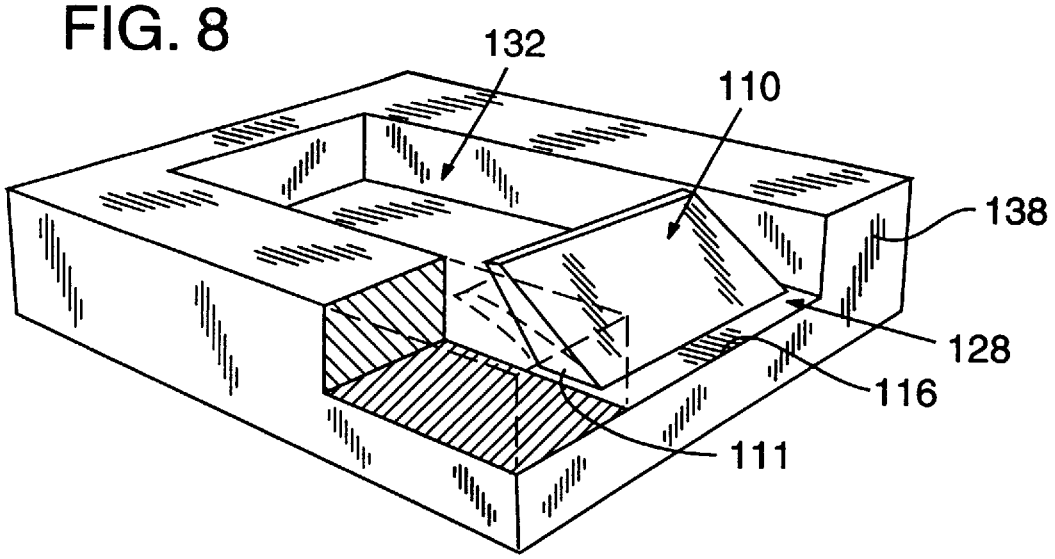
FIG. 8 is an enlarged perspective view depicting fabrication of a preferred embodiment of the valve device by laser ablation.

Fabrication of the valve member 110 depicted in FIG. 2 may also be accomplished using laser ablation techniques (FIG. 8). According to a preferred laser ablation manufacturing process, a suitable substrate 138 is transported to a laser processing chamber and the valve member 110 and firing chamber 132 are laser-ablated using one or more masks and laser radiation. The laser radiation may be generated by an excimer laser of the $F_2$, ArF, KrCl, KrF, or XeCl type. The laser system for this process generally includes beam delivery optics, alignment optics, a high precision and high speed mask shuttle system, and a processing chamber, including a mechanism for handling and positioning the substrate 138.

More specifically, the valve member 1110 may be manufactured by positioning a substrate 138, preferably comprising polyimide or other suitable polymer material, within the laser processing chamber at a relatively large half-angle with respect to a laser beam. The half-angle depends on the energy level of the laser being used. For example, utilizing a 800 mJ/cm$^2$ XeCl laser, the half-angle would preferably be about 6. The preferred half-angle increases with decreasing laser energy sources. The valve member is ablated to assume, substantially, a wedge-shape with the wider end of the wedge 111 integral with a lower surface 116 of an ink channel 128 (FIG. 8).

After the valve member 110 has been defined by laser ablation the ink channel 128 is then fully defined. The substrate of the is placed at substantially a 90 angle to the laser beam and the ink channel 128 is then ablated to a depth of about 25 $\mu$m, a width of about 25 $\mu$m, and a length of about 40 $\mu$m. The valve member 110 is deformable in an up direction (i.e., in a direction toward the upper surface of the ink channel 128) or in a down direction (i.e., in a direction toward the lower surface 116 of the ink channel 128).

The last step in the process of laser ablation is a cleaning step wherein the laser ablated portion of the substrate 138 is positioned under a cleaning station (not shown). At the cleaning station debris from the laser ablation is removed according to standard industry practice.

Laser-ablation processes for forming the valve member and the ink-jet channels have numerous advantages as compared to conventional lithographic electroforming processes. For example, laser ablation processes generally are less expensive and simpler than conventional lithographic electroforming processes. In addition, by using laser ablation, the valve members and channels may have geometries that are not practical when utilizing conventional electroforming processes.

Although an excimer laser is used in the preferred embodiment, other ultraviolet-light sources with substantially the same wavelength and energy density may be used to accomplish the ablation process. Preferably, the wave length of such an ultraviolet light source will lie in the 150 nm to a 400 nm range to allow high absorption in the substrate to be ablated. Furthermore, the energy density should be greater than about 100 millijoules per square centimeter with a pulse length shorter than about 1 microsecond to achieve rapid ejection of ablated material with essentially no heating of the surrounding remaining material.

Figure 3:
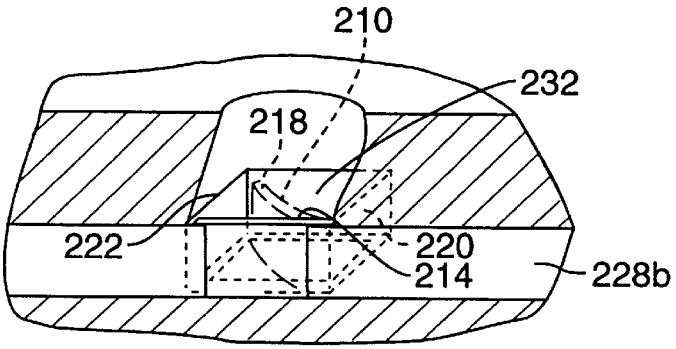
FIG. 3 is an enlarged cross-sectional partial view of another preferred embodiment of the valve device of the present invention.

In another preferred embodiment of the present invention, valve member 210 is integrally connected to a side wall of firing chamber 232 (FIG. 3). Preferably, valve member 210 is affixed at one end (fixed-end) 214 to firing chamber wall 220. The second or free end 218 of the valve member is deformable in a direction toward the interior of the firing chamber 232 or in a direction toward ink channel 228*b*.

Valve member 210 may be fabricated to be in a normally open position (represented by dashed lines in FIG. 3) or in a normally closed position (represented by solid lines in FIG. 3). When the ink pressure in the firing chamber 232 is less than or equal to the fluid ink pressure in the ink channel 228*b* adjacent the firing chamber, the valve member 210 is in an open position and ink may flow from the ink channel into the firing chamber. As fluid pressure within the firing chamber 232 increases above a preselected level, valve member 210 is deflected to a closed position and the free end 218 of the valve member moves in a direction toward the ink channel 228*b* thereby substantially occluding ink flow from the firing chamber to the ink channel.

Figure 5A:
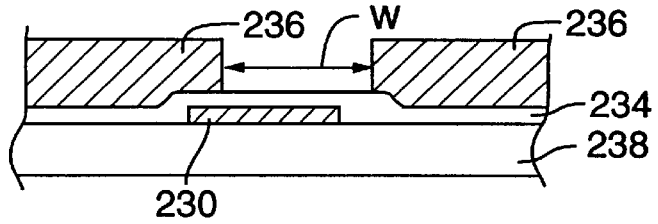
FIGS. 5*a*–5*d* depict the sequence of steps for fabricating the embodiment of FIG. 3.
Figure 5B:
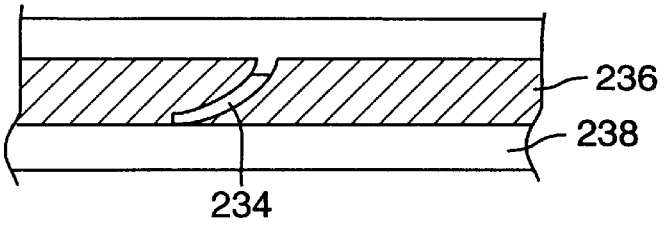
Figure 5C:
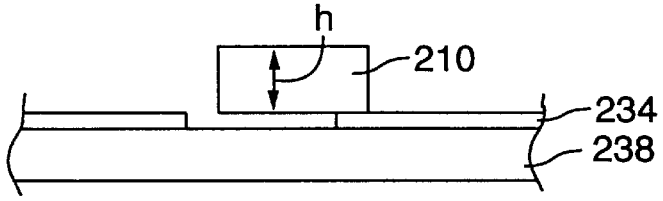
Figure 5D:
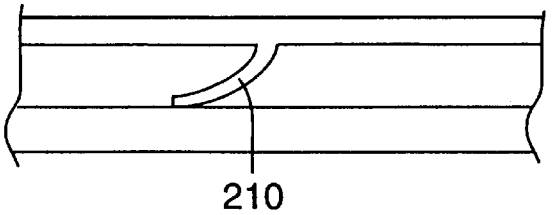

The embodiment of valve member 210 depicted in FIG. 3 may be fabricated utilizing thin-film layering techniques (illustrated in FIGS. 5*a*–5*d*). FIGS. 5*a* and 5*c* are side views of a preferred embodiment of valve member 210 while Figs. 5*b* and 5*d* are the corresponding top views of the valve member. Valve member 210 may be fabricated by plating on top of a plated metallic substrate or a polymer substrate 238 (Fig. 5*a*). Suitable plated metallic substrates preferably comprise nickel, while suitable polymer substrates preferably comprise polyimide.

A thin sacrificial photoresist layer 230 is applied to substrate 238 at a thickness of about 1 m and patterned to define what will be the length of valve member 210 (FIG. 5*a*). Sacrificial layer 230 will be removed later to allow valve member 210 to move free of substrate 238.

A thin conductor layer 234 is applied uniformly over the exposed portions of substrate 238 and sacrificial layer 230 (Fig. 5*a*). A preferred conductor layer 234 comprises the same materials in the same dimensions as discussed above in relation to the conductor layer 134 of the embodiment discussed above. The portion of conductor layer 234 that will not become valve member 210 is patterned with photoresist layer 236 and removed using a suitable etchant (FIG. 5*a*).

Sacrificial photoresist layer 236 defines the height and width of valve member 210 (Figs. 5*a* and 5*c*). Sacrificial layer 236 is preferably about 5 m thicker than the desired height of valve member 210. Valve member 210 is then deposited, preferably comprising nickel deposited by conventional plating technique (FIGS. 5*c* and 5*d*). Photoresist layers 230 and 236 are then removed allowing valve member 210 to flex in a left/right direction (FIGS. 5*c* and 5*d*).

Figure 9:
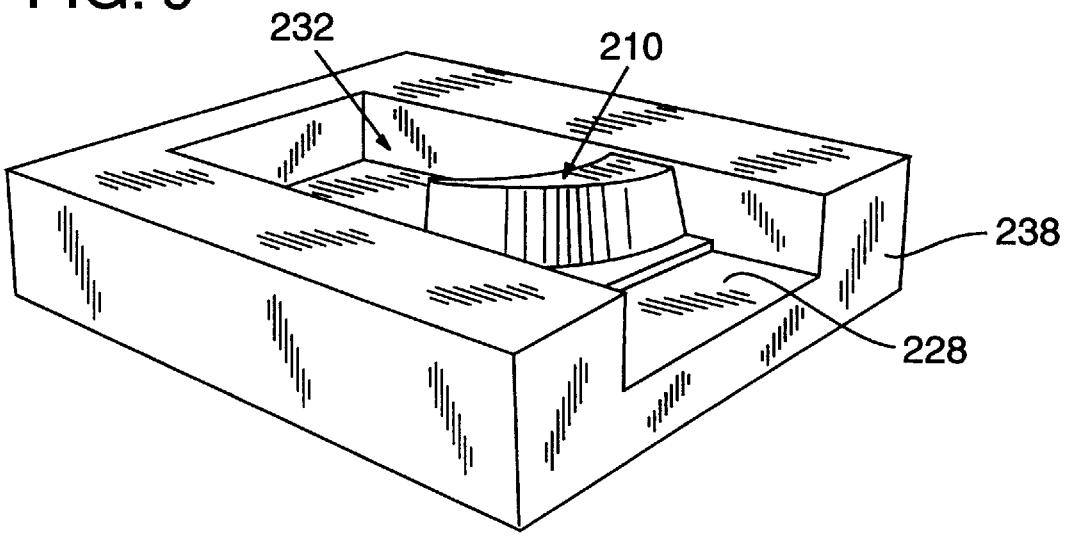
FIG. 9 is an enlarged perspective view depicting fabrication of a preferred embodiment of the valve device by laser ablation.

Laser ablation techniques may also be used to fabricate the embodiment of valve member 210 depicted in FIG. 3. In a preferred process, a suitable substrate 238 is transported to a laser processing chamber and the valve member 210 and firing chamber 232 are laser-ablated using one or more masks and laser radiation (FIG. 9).

The laser radiation may be generated by an excimer laser of the $F_2$, ArF, KrCl, KrF, or XeCl type. The laser system for this process generally includes beam delivery optics, alignment optics, a high precision and high speed mask shuttle system, and a processing chamber, including a mechanism for handling and positioning the substrate 238.

More specifically, with the substrate positioned perpendicular to a the laser beam, the valve member 210 is defined through a laser mask using laser radiation. The adjacent ink channel is also defined during the same ablation process utilizing another mask or alternatively, the channel pattern may be placed side-by-side on a common mask which includes the valve pattern. The patterns for the valve and channels may be moved sequentially into the laser beam. The masking material used in such masks will preferably be highly reflecting at the selected laser wavelength, consisting of, for example, a multi-layer dielectric or a metal such as aluminum. The substrate 238 is then turned over and the back side of the substrate laser ablated to free the valve member 210 from the ink channel 228.

Figure 6A:
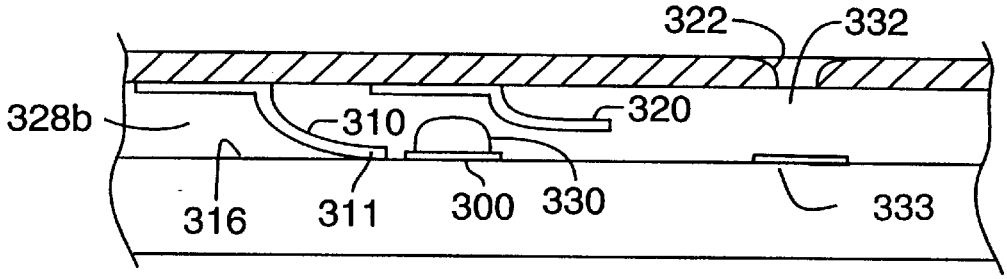
FIGS. 6*a*–6*b* are enlarged, cross-sectional, partial views of another embodiment of the present invention.
Figure 6B:
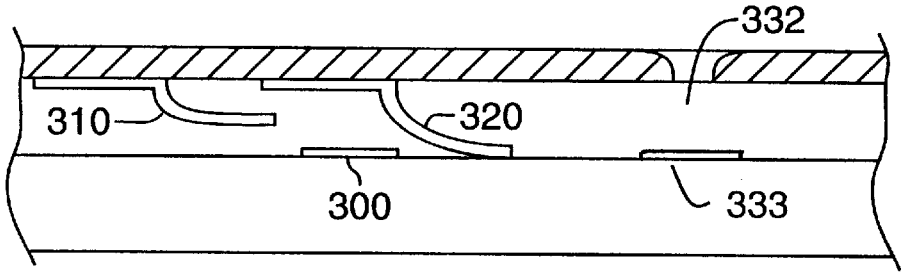

Another preferred embodiment of the present invention combines two or more valve members with an actuator source such as, for example, a resistor or a piezoelectric transducer (FIGS. 6*a*–6*b*). In such a combination, the valve members may be configured within the printhead ink channel 328b to pump a preselected volume of fluid, such as ink, through the channel.

More specifically, a resistor 300, or other actuator, is interposed between two valve members 310, 320. The valve members are fabricated such that the valve members are normally in a non-deformed, closed position, capable of deforming to an open position. That is, free-end 311 of the valve member is normally in contact with lower surface 316 of ink channel 328*b,* such that ink flow through the ink channel is significantly reduced. There is a preselected volume of ink stored within the channel 328*b* between the two valve members 310 and 320.

The ink pumping operation comprises two steps. First, as resistor 300 is heated an ink bubble 330 is formed. As the ink bubble 330 expands the downstream valve member 320 flexes to an open position due to the fluid pressure caused by the expanding bubble. In the open position, ink stored between valves 310 and 320 flows past valve member 320, toward ink chamber 332 and its attendant this film resistor 333 (FIG. 6*a*).

As the ink bubble 330 expansion force causes valve member 320 to open and ink flows in a downstream direction (i.e., toward ink chamber 332), fluid pressure within the ink channel between the two valve members 310, 320 is reduced. The pressure drop creates a gradient that causes the upstream valve member 310 to flex to an open position, and causes the downstream valve member 320 to close (FIG. 6*b*). As the upstream valve member 310 opens, the ink channel volume defined between the two valve members is refilled with ink. This ink is stored in the ink channel 328*b* between the valve members 310 and 320 until resistor 300 is activated again.

The volume of ink pumped depends on the energy level of resistor 300 and the geometry of ink channel 328*b*. For example, with a 25 m resistor and an ink channel 25 m wide, 25 $\mu$m high and 50 $\mu$m in length, a pumped volume of about 20 pl of ink is obtained.

Figure 7:
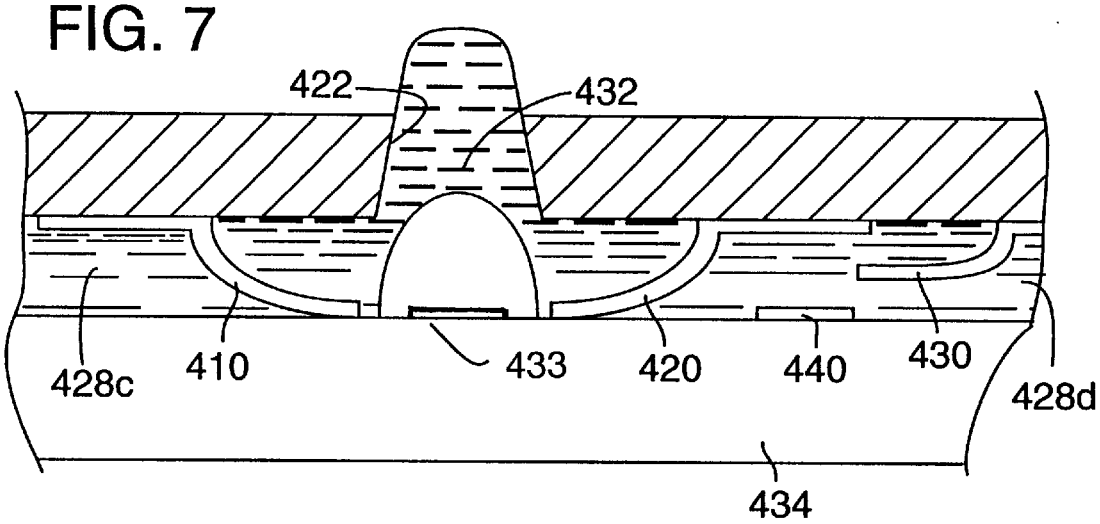
FIG. 7 is an enlarged cross-sectional partial view of another preferred embodiment of the valve device of the present invention.

Another embodiment of the present invention, utilizes three or more valve members 410, 420, 430 to control fluid flow in an ink-jet printhead 20 while simultaneously increasing gray scale print capabilities (FIG. 7).

Increasing gray scale print capabilities produces sharper, more definite images. A preferred embodiment of the present invention enables one to vary ink dye-load of a drop of ink thereby varying print gray scale through control of the fluid flow within an ink-jet printhead.

Specifically, two ink channels 428*c* and 428*d* are in fluid communication with a single ink firing chamber 432. A first ink channel 428*c* is also in fluid communication with a low dye-load ink supply while a second ink channel 428*d* is in fluid communication with a high dye-load ink supply.

Three valve members 410, 420 and 430 are oriented within the first 428*c* and second 428*d* ink channels. The valve members 410, 420 and 430 are fabricated such that they are in a closed position when in a non-deformed state. That is, the flow of ink at each valve member is substantially occluded unless the valve member is deformed or is in an open position. At least two valve members 420, 430 are located in the second, high dye-load ink channel 428*d,* with a heating element 440, such as a resistor positioned therebetween. The concentration of ink in the firing chamber is varied by selectively pumping high dye-load ink from the second ink channel 428*d* (i.e., firing the resistor 440). As low dye-load ink flowing through the first ink channel 428*c* enters the firing chamber 432 a volume of high dye-load ink is pumped from the second ink channel 428*d* to the firing chamber. The volume of high dye-load ink pumped and the pumping mechanism operate as described in the above preferred embodiment. The high and low dye-load inks mix in the firing chamber and the mixture is then ejected through nozzle 422 by its attendent heater 433.

Having described and illustrated the principles of the invention with reference to preferred embodiments, it should be apparent that the invention can be further modified in arrangement and detail without departing from such principles. For example, the valve member may be used individually or various numbers of valve members may be utilized in combination, the valves being positioned in various locations in the ink-jet printhead to achieve results similar to those results discussed herein in reference to alternative preferred embodiments of the present invention.

What is claimed is:

1. A system for controlling fluid pressure within an ink-jet printhead comprising:

a printhead having a base defining a first ink channel wherein a portion of the first ink channel defines a volume for storing ink, the first ink channel in fluid communication with a firing chamber from which droplets are ejected from the printhead;

a heater located in the firing chamber for heating the ink in the chamber, thereby to eject the droplets from the chamber;

at least two resiliently flexible flaps mounted within the first ink channel defining a volume for storing ink therebetween, a first flap of the two flaps being spaced from a second flap of the two flaps;

a heating element located between the two flaps that, when activated, heats a volume of ink between the flaps causing the first flap to deflect to a closed position and the second flap to deflect to an open position thereby moving the volume of ink past the second flap; and a second ink channel in the base of the printhead wherein a portion of the second ink channel defines a volume for storing ink, the second ink channel including a flexible ink flap mounted therein, the second ink channel in fluid communication with the firing chamber such that the flap in the second ink channel moves into a position for restricting fluid flow through that channel in response to ejection of an ink droplet from the firing chamber.

2. The system of claim 1 wherein the first ink channel defines a volume for storing a high dye-load ink.

3. The system of claim 1 wherein the resiliently flexible flaps are constructed by a microfabrication process.

4. The system of claim 1 wherein the resiliently flexible flaps are constructed by a laser ablation process.

5. A method for controlling fluid pressure within an ink-jet printhead comprising the steps of:

providing a printhead including a fluid passageway wherein the fluid passageway defines a volume for storing ink, the fluid passageway in fluid communication with a firing chamber having a nozzle through which ink droplets are ejected by a heater from the printhead;

affixing a pair of spaced apart flexible valve members to the printhead within the fluid passageway;

mounting a heating element between the pair of valve members;

moving the valve members in response to pressure changes in the passageway induced by the heating element such that ink may flow through the fluid passageway and into the firing chamber for ejection by the heater and affixing a third valve member to the printhead within a second fluid passageway that defines another volume for storing ink, the second fluid passageway being in fluid communication with the firing chamber; and moving the third flexible valve member in response to pressure changes in the passageway induced by the heater in the firing chamber to an open position such that ink may flow through the second fluid passageway and to a closed position such that ink flow through the second fluid passageway is restricted.

6. The method of claim 5 including the step of constructing the flexible valve members utilizing microfabrication techniques.

7. The method of claim 5 including the step of constructing the flexible valve members utilizing laser ablation techniques.

* * * * *